US006253962B1

(12) United States Patent
Hürlimann

(10) Patent No.: US 6,253,962 B1
(45) Date of Patent: Jul. 3, 2001

(54) DEVICE FOR PRESSING OUT TUBES

(75) Inventor: Paul Hürlimann, Baden (CH)

(73) Assignee: Arthur Hardmeier, Ennftbaden (CH)

( * ) Notice: Subject to any disclaimer, the term of this patent is extended or adjusted under 35 U.S.C. 154(b) by 0 days.

(21) Appl. No.: 09/423,451

(22) PCT Filed: Apr. 16, 1998

(86) PCT No.: PCT/CH98/00144

§ 371 Date: Jan. 31, 2000

§ 102(e) Date: Jan. 31, 2000

(87) PCT Pub. No.: WO98/47782

PCT Pub. Date: Apr. 23, 1997

(30) Foreign Application Priority Data

Apr. 23, 1997 (CH) ..... 0948/97

(51) Int. Cl.[7] ..... B65D 35/28
(52) U.S. Cl. ..... 222/102
(58) Field of Search ..... 222/102, 101, 222/95, 92

(56) References Cited

U.S. PATENT DOCUMENTS 1,773,104 * 8/1930 Johnson ..... 222/102
1,983,462 * 12/1934 Johnson ..... 222/102
2,358,989 * 9/1944 Marcy ..... 222/102
5,297,699 * 3/1994 Barchus ..... 222/102

* cited by examiner

*Primary Examiner*—Joseph A. Kaufman
*Assistant Examiner*—David Deal
(74) *Attorney, Agent, or Firm*—James E. Klaniecki; Ann W. Speckman

(57) ABSTRACT

A device for squeezing tubes consisting of two press rolls (1) arranged facing each other which can be placed onto the sides of a tube. Into the face side openings (1*a*) of the press rolls (1) pot-shaped sleeves (2) are inserted. These pot-shaped sleeves (2) towards the inside are provided with bottom parts (2*a*) with passage openings (2*b*). Into each of the pot-shaped sleeves (2) arranged superimposed of the press rolls (1) the arms (3*a,b,c*) of U-shaped spring clamps (3) are inserted through the passage openings and are guided shiftably therein. The end parts (3*c*) of the arms (3*a,b,c*) of said spring clamps (3) each are provided with a protrusion (4) which blocks passage of the arms (3*a,b,c*) through the passage openings (2*b*).

6 Claims, 1 Drawing Sheet

DEVICE FOR PRESSING OUT TUBES

BACKGROUND OF THE INVENTION

1. Field of the Invention

The present invention concerns a device for squeezing tubes comprising two press rolls facing each other which can be placed onto the sides of a tube, and spring clamps with two essentially parallel oriented tensioning elements, which are led through the press rolls and form axes of rotation for the press rolls and pressing them against each other.

2. Description of the Prior Art

Devices of such type are known in many layouts. Apart from propositions according to which the press rolls are supported in a holder frame and one of the rolls is driven via a teeth and lever mechanism with a reverse locking device (DE-A1-3007015 and CH-A-605'302) also a device is known in which the press rolls are toothed longitudinally and are supported in mutually connectable U-frames in which arrangement one of the press rolls is provided with a turning handle (CH-A-635043). Furthermore it has been proposed that the end portions of the press rolls be interconnected by elastic tensioning rings and that the pair of press rolls be placed onto the tube manually (U.S. Pat. No. 5,277,335). In a further proposal instead of the tensioning rings a spring clamp is used with two tensioning elements extending essentially parallel which are led through the press rolls and form axis of rotation for the press rolls and pressing them against each other (U.S. Pat. No. 5,297,699).

None of these devices has achieved success in practical application, because either the elements of the construction were to cumbersome or too cost intensive or because handling the device proved too difficult.

SUMMARY OF THE INVENTION

Based on the layout mentioned first, it is the object of the present invention to improve this design in such a manner that on one hand simple elements can be used in the device and that on the other hand easy handling is rendered feasible.

This object is achieved by using a layout in which pot-shaped sleeves are inserted in both face side openings of the press rolls, the inward facing pot bottom parts of the sleeves are provided with passage openings, whereas the arms of U-shaped spring clamps are guided movably through the passage openings in each of the pot-shaped sleeves which are lying over each other. The end portions of the arms of the spring clamps in this arrangement, as claimed additionally in the present invention, are provided with a protrusion each blocking the passing through the passage openings. The arms of the U-shaped spring clamps according to a further proposal of the present invention are of a length which is greater than twice the length of the pot-shaped sleeves, whereas the first part extending from the U-shaped bend is somewhat longer than the pot-shaped sleeve and extends inclined under an acute angle towards the longitudinal centre axis of the U-profile of the U-shaped spring clamp, and the adjacent second part is of about the same length as the first part and is inclined correspondingly away from said axis, and the short end part extends bent again towards the longitudinal centre axis. The pot-shaped sleeves are provided preferentially with an outer annular ring flange resting against the face side opening rim of the press rolls, and the U-shaped bend of the U-shaped spring clamp is provided preferentially with an attached grip element.

The layout of the device according to the present invention, which merely comprises the two press rolls, the pot-shaped sleeves inserted into the end portions of the rolls, and a pair of U-shaped spring clamps does not contain other elements than the ones mentioned which are easily manufactured and assembled using just a few manual or machine-made production steps. The inclination under an acute angle of the first arm parts of the U-shaped spring clamps towards the longitudinal center axis of the U-profile ensures that owing to the rotation of the press rolls the clamp is pushed longitudinally towards the inside of the roll and that it thus can not escape from the pot-shaped sleeve, whereas the inclination under an acute angle of the adjacent second part of the arm ensures that the pressure between the press rolls is released almost completely as the U-shaped spring clamps are pulled in longitudinal direction out of the press rolls. Then, the press rolls easily can be pushed onto the tube and subsequently the clamps can be brought back to their pressing position if they are pushed towards the centre using the attached grip end portions. The contact pressure is transmitted via the angled-off portions of the arms of the U-shaped spring clamps essentially to the center of the axis of the press rolls and thus permits their linear displacement without effort.

BRIEF DESCRIPTION OF THE DRAWINGS

The present invention is described in more detail in the following with reference to the specified example illustrated in the drawings. It is shown in.

DETAILED DESCRIPTION OF THE INVENTION

Figure 1:
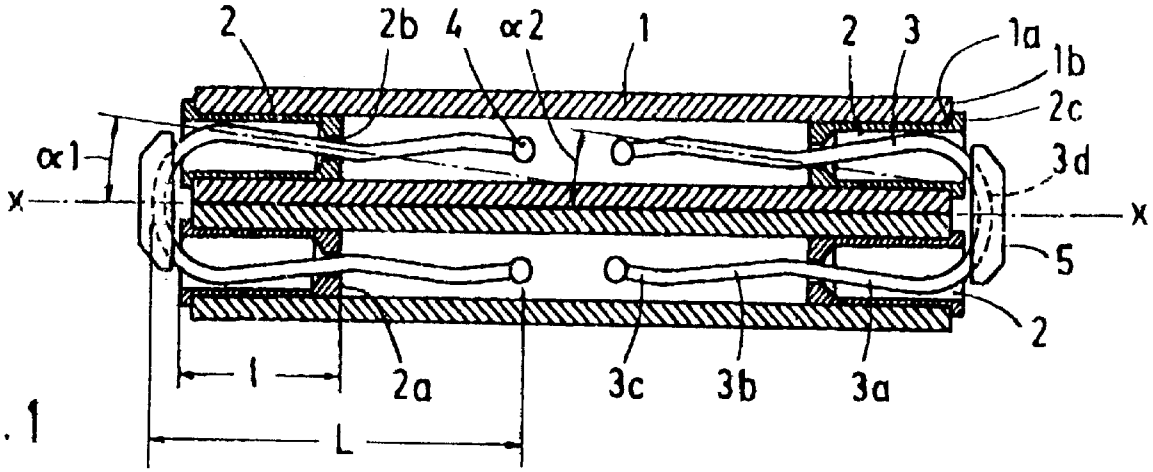
FIG. 1 the device in its pressing position shown in an axial cross-section, and in FIG. 2 the device according to FIG. 1 in its released position shown in the same manner.

As can be seen from FIG. 1 in the face side openings 1*a* of the press rolls 1 pot-shaped sleeves 2 are inserted which rest with an outer annular ring flange against the face opening rims 1*b* of the press rolls 1. In the bottom parts 2*a* of the pot-shaped sleeves 2 passage openings 2*b* are provided. The two press rolls 1 are held together by U-shaped spring clamps 3, the two arms 3*a,b,c* of which each are guided movably longitudinally in one of the pot-shaped sleeves 2 and through the passage opening in the sleeve bottom 2*a*. The U-shaped spring clamps 3 have a length L which is slightly greater than twice the length 1 of the pot-shaped sleeve 2. Each of the first parts 3*a* of the arms 3*a,b,c* extending from the U-shaped bend 3*d* of the U-shaped spring clamp 3 is slightly longer than the length I of the pot-shaped sleeve 2 and extends inclined under an acute angle $\alpha 1$ towards the longitudinal center axis x—x of the U-shaped spring clamp 3, and the subsequent second part 3*b* of the arms 3*a,b,c* extends under a corresponding angle $\alpha 2$ inclined away from the longitudinal centre axis x—x and has about the same length as the arm part 3*a*. The adjacent end part 3*c* of the arm 3*a,b,c* extends bent again towards the longitudinal centre axis x—x and ends in protrusion 4 which blocks the arm from passing through the passage opening 2*b*. On the U-shape bend 3*d* of the U-shaped spring clamp 3 a grip element 5 is attached which here is laid out in the form of a disk button.

The two press rolls 1 in their position shown in the FIG. 1 are pressed against each other elastically and against the tube (not shown) inserted between the rolls by the parts 3*a* of the arms 3*a,b,c* of the U-shaped spring clamp 3 pressed into the pot-shaped sleeves 2. The contact pressure owing to the inclination under an acute angle of the arm part 3*a* is exerted towards the longitudinal centre axis x—x and generates a component in axial direction to the inside in such a manner that outwards escape movements of the clamp during the pressing action of the press rolls 1 on the tube are prevented.

Figure 2:
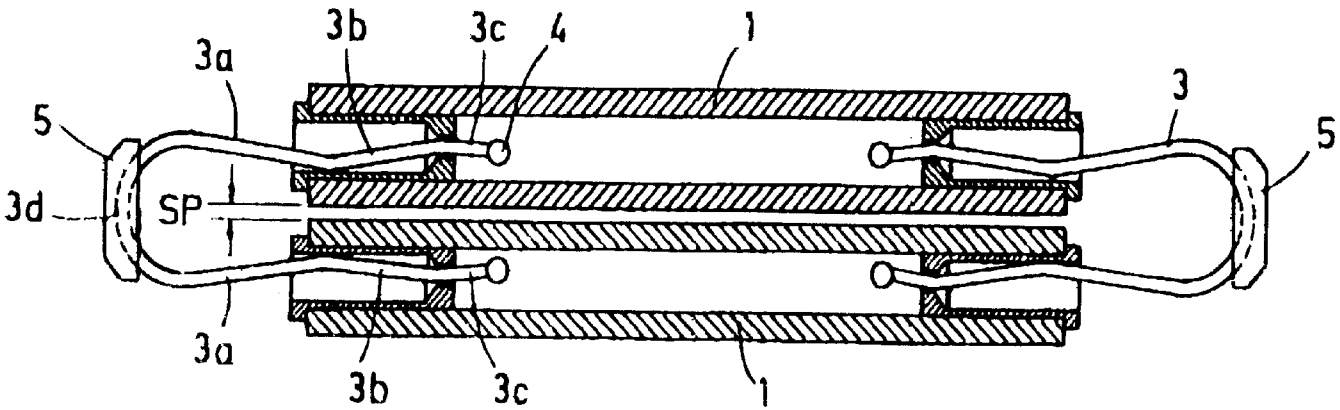

If, as shown in FIG. 2, the two spring clamps 3 are pulled outwards from the press rolls 1 by using the attached grip elements 5, the inclination under an acute angle of the second arm parts 3*b* ensures that the press rolls 1 almost completely are relieved from pressure and thus a gap SP between the press rolls 1 is opened through which the tube (not shown) can be inserted. The protrusions 4 in this arrangement act as stops preventing complete removal of the U-shaped spring clamps 3 from the press rolls 1, or from the pot-shaped sleeves 2 respectively.

I claim:

1. A device for squeezing tubes comprising:

a top and bottom press roll arranged parallel to one another, wherein the press rolls have a centrally oriented aperture at each end face;

a left and right sleeve retained within respective end face apertures of each press roll; and a pair of spring clamps arranged opposing one another at the end faces of the press rolls that are slideably held within the sleeves such that the press rolls are held parallel to one another in close association and can be adjusted to an open or closed position.

2. The device according to claim 1, wherein the sleeves comprise a hollow columnar body having a base section with a passage opening, and wherein the spring clamps are U-shaped having a longitudinal center axis and comprise a first and second tension arm essentially parallel to one another, and wherein the first and second tension arms have a compressive section, a non-compressive section and an end section, said tension arms being slideably engaged in passage openings of respective sleeves such that the first tension arm of each spring clamp forms a rotational axis for the top press roll and the second tension arm of each spring clamp forms a rotational axis for the bottom press roll.

3. The device according to claim 2, wherein the U-shaped spring clamps are approximately twice the length of the sleeves and wherein the compressive sections of the tension arms are somewhat longer than the sleeve length and are bent at an acute angle towards the longitudinal center axis of the spring clamp, and wherein the non-compressive sections of tension arms are essentially equal in length to the compressive sections and are bent at an acute angle away from the longitudinal center axis of the spring clamp, and wherein the end sections are shorter than the compressive and non-compressive sections and are bent at an acute angle towards the longitudinal center axis of the spring clamp such that when the spring clamps are withdrawn from the sleeves and the non-compressive sections engage the passage openings the device is in the open position and a gap is provided between the press rolls for receiving a tube, and when the spring clamps are pressed into the sleeves and the compressive sections engage the passage openings the device is in the closed position wherein the press rolls are brought into tight association onto the tube.

4. The device according to claim 2, wherein the tension arm's end section of spring clamp further comprises a protrusion that is larger than the passage opening of the sleeve thereby preventing the spring clamps from being removed from the sleeves.

5. The device according to claim 1, wherein the sleeve further comprises an outer annular ring flange for engaging the end face of the press roll.

6. The device according to claim 1, further comprising a handle element in association with the spring clamps.

* * * * *